US006200246B1

(12) United States Patent
Perazzolo

(10) Patent No.: US 6,200,246 B1
(45) Date of Patent: Mar. 13, 2001

(54) GRIPPER ELEMENT FOR A PUNCH OR A DIE OF A PUNCHING MACHINE

(75) Inventor: Eugenio Perazzolo, Rovigo (IT)

(73) Assignee: Rainer S.R.L., Calderara di Reno (IT)

( * ) Notice: Subject to any disclaimer, the term of this patent is extended or adjusted under 35 U.S.C. 154(b) by 0 days.

(21) Appl. No.: 09/116,652

(22) Filed: Jul. 16, 1998

(30) Foreign Application Priority Data

Jul. 16, 1997 (IT) ..... BO97A0429

(51) Int. Cl.[7] ..... B23Q 3/155

(52) U.S. Cl. ..... 483/28; 72/446; 83/563; 483/29

(58) Field of Search ..... 483/28, 29; 72/446, 72/448; 83/563, 550, 551, 552, 549, 559

(56) References Cited

U.S. PATENT DOCUMENTS

| | | | | |
|---|---|---|---|---|
| 3,678,562 | | 7/1972 | Leibinger | 29/400 |
| 4,486,941 | | 12/1984 | Scott et al. | 29/568 |
| 4,587,716 | * | 5/1986 | Bytow | 483/29 |
| 4,649,622 | | 3/1987 | Scott | 29/568 |
| 4,843,704 | * | 7/1989 | Sakamoto | 483/29 |
| 4,878,288 | * | 11/1989 | Messner | 72/446 |
| 5,224,915 | | 7/1993 | Kilian | 483/1 |
| 5,295,938 | * | 3/1994 | Jilsen | 483/29 |
| 5,346,454 | | 9/1994 | Hayashi | 483/29 |
| 5,545,116 | | 8/1996 | Seto | 483/1 |
| 5,913,760 | | 6/1999 | Kamada et al. | 483/1 |

FOREIGN PATENT DOCUMENTS

| | | | | |
|---|---|---|---|---|
| 2240293 | * | 4/1991 | (GB) | 483/29 |
| 9500267 | | 1/1995 | (WO) . | |

* cited by examiner

*Primary Examiner*—William Briggs
(74) *Attorney, Agent, or Firm*—Ladas & Parry

(57) ABSTRACT

The machine includes two turrets carrying a plurality of punch-die pairs, a magazine for these pairs, and a device for changing over the pairs. This device is formed from at least one changeover arm having two gripper elements, each comprising a pair of jaws operable by a common actuator. The two jaws are provided with a through-pin and are each engagable in a pair of channels, perpendicular to each other, carried by a flange of the punch or the die. When the gripper element moves parallel to the axis of the punch or the die, a first channel of the pair is disposed axially and has a quadrangular section, while the other channel is tangential and has a triangular section.

16 Claims, 3 Drawing Sheets

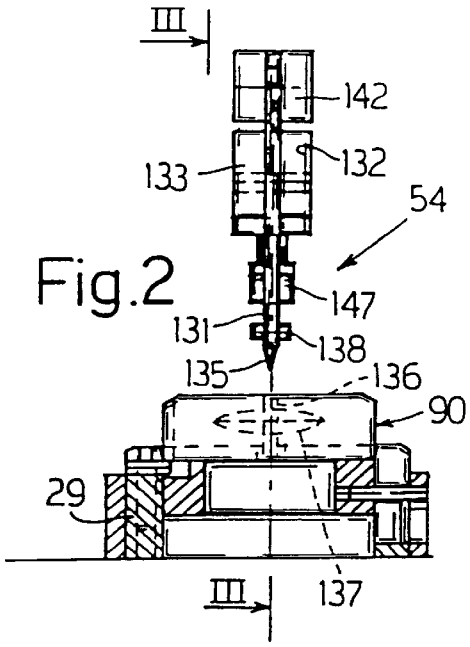
Fig.2
Fig.3
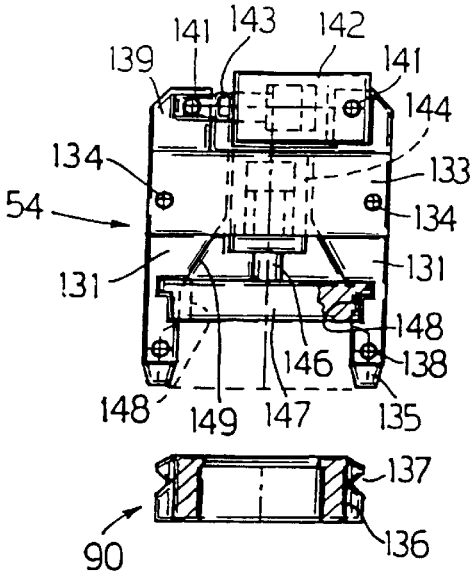
Fig.4
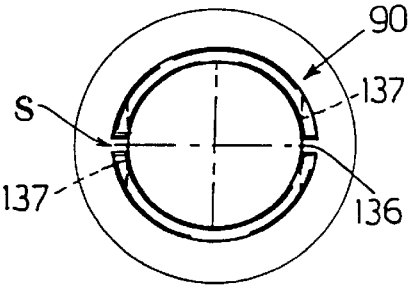
Fig.5
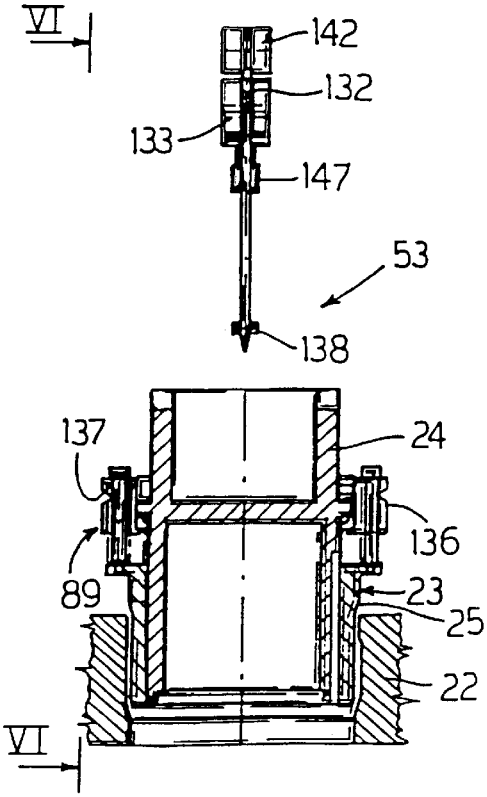
Fig.6
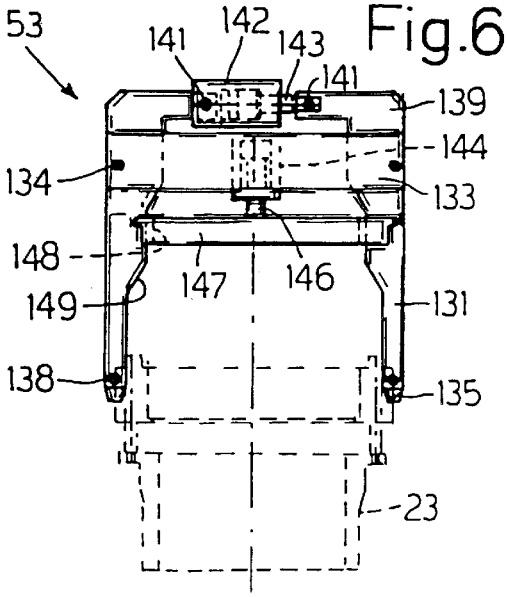

GRIPPER ELEMENT FOR A PUNCH OR A DIE OF A PUNCHING MACHINE

BACKGROUND OF THE INVENTION

The present invention concerns a gripper element for a punch or a die of a punching machine. In particular, the invention concerns a gripper element for an arm of a changeover device of a turret punching machine.

Different kinds of turret punching machines are known, provided with a device for exchanging the punch and die pair between the turrets and a magazine of such pairs. In one known machine, each end of the changeover arm has a gripper element formed from two leaf springs, each having a rib for snap-engaging a channel extending from the punch or the die.

This gripper element has the disadvantage of requiring a pair of pneumatic pistons, one for removing the punch or die from the leaf springs, and the other for removing them from their seat and re-engaging them with the leaf springs. Furthermore, the elastic thrust of the leaf springs does not allow the punch or die to be rigidly secured to the gripper element. Finally, this gripper element does not exhibit any angular reference for holding the punch or die.

In another known machine, the gripper element is operated by an axial pneumatic cylinder and comprises two rigid jaws pivoted to the rod of the pneumatic piston. The two jaws are rotated in a mutually opposite direction by means of a fixed cam profile, and are adapted to engage two diametrically-opposed cavities located outside the punch or in an axial hole of the die.

This gripper element has the disadvantage of requiring two different types of jaws for the punch and the die. Furthermore, the connection between two diametrically-opposed cavities does not ensure such a reference as to connect the jaws firmly to the punch or the die during the movement of the changeover arm.

SUMMARY OF THE INVENTION

The object of the invention is to produce a gripper element for a punch or die of a punching machine, which is both very simple and very reliable to operate, and which eliminates the disadvantages described above in relation to the known gripper elements.

This object is achieved by a gripper element for a punch or a die according to the invention, for a punching machine provided with a changeover device for a punch-die pair, including a pair of jaws operable by a common actuator, and characterised in that the said jaws are moveable so as to engage corresponding pairs of channels in a flange of the said punch or the said die.

BRIEF DESCRIPTION OF THE DRAWINGS

For a better understanding of the invention, two preferred embodiments are now described, given by way of example with reference to the accompanying drawings, in which:

FIG. 2 is a side view on an enlarged scale of a gripper element for a die of the machine of FIG. 1;

FIG. 3 is a section taken on the line III—III of FIG. 2;

FIG. 4 is a plan view of the die of FIG. 2;

FIG. 5 is a side view on an enlarged scale of a gripper element for a punch of the machine of FIG. 1;

FIG. 6 is a section taken on the line VI—VI of FIG. 5;

DETAILED DESCRIPTION OF THE INVENTION

Figure 1:
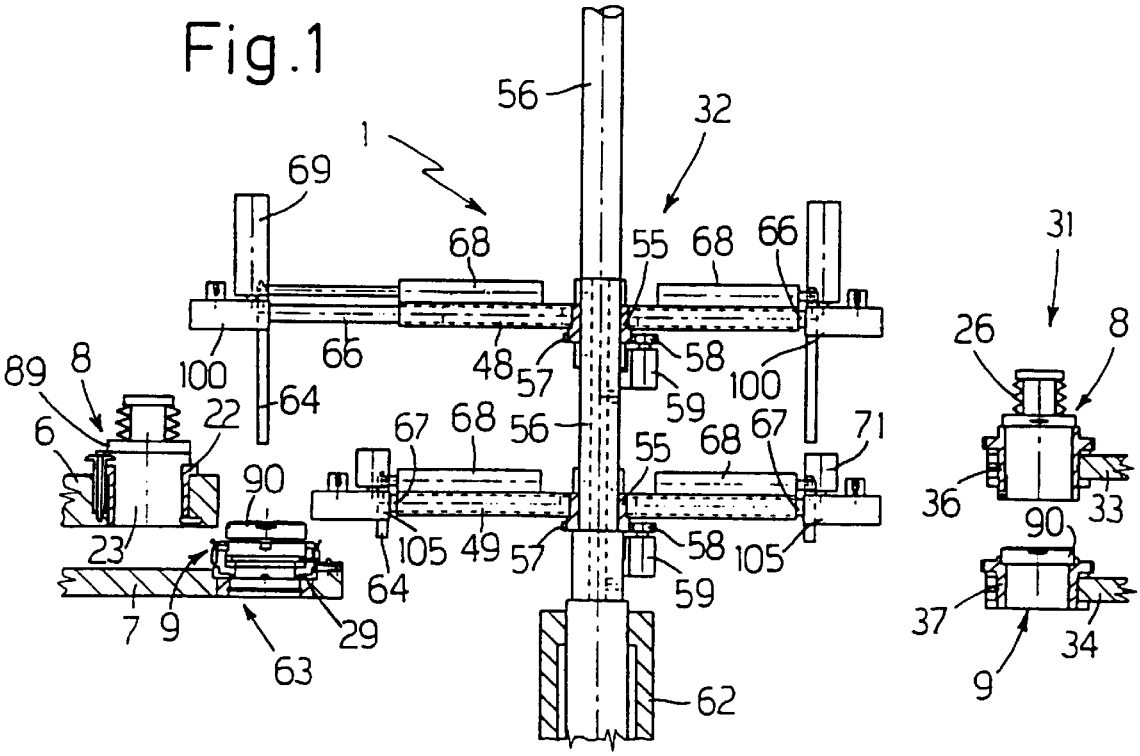
FIG. 1 is a partial vertical section of a turret punching machine incorporating a gripper element according to a first embodiment of the invention.
Figure 10:
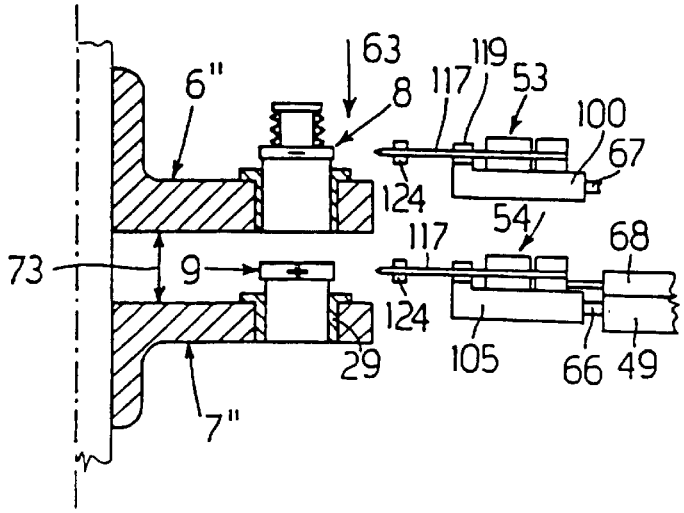
FIG. 10 is a partial vertical section of a variant of the punching machine of FIG. 1, incorporating the gripper element of FIG. 7.

With reference to FIG. 1, the reference numeral 1 generally indicates a punching machine for working sheet metal, including a work station, not visible in the drawing. The machine 1 is of the turret type and includes a pair of superimposed turrets 6 and 7. The upper turret 6 is provided with a plurality of seats 22, each carrying a punch 8, while the lower turret 7 is provided with a corresponding plurality of seats 29, each carrying a die 9. The turrets 6 and 7 are selectively rotatable in order to select the punch-die pair 8, 9 to carry to the work station.

The machine 1 is provided with a magazine 31 for a series of punch-die pairs 8, 9, and a device 32 for exchanging these pairs between the turrets 6, 7 and the magazine 31. The magazine 31 comprises at least one pair of supports 33, 34, the upper support 33 being provided with a series of seats 36, each capable of accommodating a punch 8, while the lower support 34 is provided with a corresponding series of seats 37, each capable of accommodating a die 9.

The punch 8 and die 9 are each provided with a flange 89, 90. In particular, the punch 8 is formed from a punch holder 23 (see also FIG. 5) insertable in the seat 22, and a punch tool 24. The flange 89 of the punch 8 is formed on the punch tool 24 which is axially slidable into the holder 23 to a certain extent, against the action of a spring 26. The holder 23 is provided with a truncated cone-shape zone 25 to assist the insertion of the utensil 8 into the seat 22, 37.

The upper turret 6 has a smaller diameter than the lower turret 7, and so they are rotatable on two offset axes. A changeover station 63 for the punch-die pair 8, 9 is located in a zone where the upper turret 6 does not cover the lower turret 7.

The machine 1 is also provided with a changeover device 32 for the punch-die pair 8, 9, comprising a pair of equal arms 48, 49 respectively for the punches 8 and the dies 9, which are pivoted at their centre point. Each arm 48, 49 has two ends provided with two supports 100, 105 on each of which a corresponding gripper element 53 (FIGS. 5 and 6) for the punch 8 and, respectively, a gripper element 54 (FIGS. 2 and 3) for the die 9 can be releasably mounted in known way.

Each of the two arms 48 and 49 (FIG. 1) is fixed to a corresponding sleeve 55 which is angularly rotatable but not axially moveable on a vertical cylindrical rod 56. Each sleeve 55 is fixed to a corresponding toothed wheel 57 in engagement with a pinion 58 of a corresponding reversible servomotor 59, carried on the rod 56. The rod 56 is vertically moveable by means of a pneumatic cylinder 62.

Each support 100, 105 is slideable on a prismatic vertical guide 64 carried on a rod 66, 67. The support 100, 105 is moved along the guide 64, and thus axially with respect to the axis of the rod 56, by means of corresponding pneumatic actuators 69, 71, respectively, in order to insert and remove the punches 8 and dies 9 from the seats 22, 29 of the respective turrets 6, 7 and the seats 36 and 37 of the magazine 31.

In turn, the bars 66, 67 are radially moveable on the related arm 48, 49 by means of corresponding pneumatic cylinders 68. The stroke of the actuators 71 for the supports 105 of the arm 49 is less than that of the actuators 69 for the supports 100 of the arm 48, due to the die 9 being lower than the punch 8.

According to the invention, each gripper element 53, 54 (FIGS. 2–6) includes two jaws 131, axially moveable with respect to the punch 8 and the die 9 on a plane parallel to the axis of the seats 22, 29 and 36, 37 (see FIG. 1 also). The two jaws 131 are located in a vertical slot 132 in a crosspiece 133 and are pivoted on two pins 134 of the crosspiece 133. The crosspiece 133 of FIGS. 2 and 3 is releasably connectable to the support 105 of the arm 49, while the crosspiece 133 of FIGS. 5 and 6 is releasably connectable to the support 100 of the arm 48.

The jaws 131 are engagable in two corresponding pairs of diametrically-opposed channels 136, 137 on each flange 89, 90. The channels 136, 137 of each pair are perpendicular to each other. In particular, each pair of channels 136, 137 comprises a first channel 136 having a quadrangular section, parallel to the axis of the punch 8 or the die 9, the other channel 137 having a triangular section, located tangentially on the flange 89, 90.

Each jaw 131 has quadrangular section and acts to engage the corresponding axial channel 136 of the flange 89, 90. Each jaw 131 is provided with a chamfered end 135 to assist the insertion in the channel 136. A pin 138, projecting from the quadrangular section in both directions, is also fixed in a hole adjacent the end 135 of each jaw 131. The pin 138 acts to engage the corresponding tangential channel 137 of the flange 89, 90.

The two jaws 131 are operated by a common pneumatic actuator 142, 143. In particular, each jaw 131 is provided with another end 139 having a pin 141. On one side of the two pins 141 is pivoted a pneumatic cylinder 142 and, on the other, is pivoted a rod 143 of the associated piston. A further pneumatic actuator comprises a pneumatic cylinder 144 fixed to the crossbeam 133 and a rod 146 which is fixed rigidly to an axially moveable crosspiece 147. This crosspiece 147 has two slots 148 parallel to the rod 146, in each of which a cam edge 149 of one of the jaws 131 is engaged.

The gripper element 53, 54 functions as follows.

Usually, the gripper element 53, 54 is located below the flange 89, 90. The actuator 142, 143 holds the jaws 131 open, while the actuator 144, 146 holds the crosspiece 147 in a high position. Rotating the arm 48, 49 (FIG. 1) carries the gripper elements 53, 54 to the punch 8 and the die 9 in the changeover station 63 of the turret 6 and the collection station of the magazine 31, with the jaws 131 disposed on a vertical plane parallel to that of the channels 136.

Thus, operating the cylinders 69 and 71 axially moves the supports 100, 105, lowering the crosspiece 133 so that the two jaws 131 carry the pins 138 to the level of the tangential channels 137. By now operating the cylinder 142 in such a way as to separate the two pins 141, the two jaws 131 close, engaging in the axial channels 136. The complete closure of the jaws 131 is, however, temporarily prevented by the crosspiece 147.

Immediately after initiating the engagement in the channels 136, a sensor S for these channels is excited. The sensor controls the operation of the cylinder 144 to lower the crosspiece 147. This now releases the jaws 131 which are able to close completely. The two pins 138 now engage the two tangential channels 137 so that the jaws 131 and the pins 138 lock the flange 89, 90 in two orthogonal directions. The crosspiece 133 can now be raised in order to remove the punch 8 or the die 9 from the respective seat 22, 29 and 36, 37.

In order to insert the punch 8 or the die 9 in the respective seat, the reverse movements to those described above are effected. In particular, the cylinder 144 is first operated to raise the crosspiece 147 in order to release the pins 138 from the channels 137. Finally, the cylinder 142 is operated to bring the two pins 141 together so that the jaws 131 open, freeing the flange 89, 90.

The advantages of the gripper elements 53, 54 having axially moving jaws 131, with respect to the known jaws, are obvious. In particular, the shape of the jaws 131 always ensures the horizontal and vertical alignment of the punch 8 and die 9 with the related seats 22, 29 and 36, 37. Furthermore, the actuator 144, 146 of the crosspiece 147 ensures that the flange 89, 90 is only locked when the jaws 131 are aligned with the channels 137.

According to a further embodiment of the invention, the gripper elements 53, 54 are moveable on a horizontal plane, and thus perpendicular to the axis of the punch 8 or the die 9. In particular, the gripper element 53 and 54 can be the same as each other so that the one relating to the die 9 only is shown in FIGS. 7–10.

Each gripper element 53, 54 is formed from two jaws 117 (FIGS. 7 and 8) pivoted on two pins 118 parallel to a crosspiece 119. This is releasably connectable to the support 100, 105 (see FIG. 1 also) of the arm 48, 49, in any known way. The crosspiece 119 is also provided with a controllable abutment element 120 for the flange 89, 90 of the punch 8 or die 9.

The jaws 117 are engagable in two corresponding pairs of diametrically-opposed channels 122, 123 in each flange 89, 90. The channels 122, 123 of each pair are also perpendicular to each other. A first channel 122 of each pair has a quadrangular section and is disposed tangentially on the flange 89, 90. The other channel 123 is of triangular section and is parallel to the axis of the punch 8 or die 9.

Each jaw 117 has a quadrangular section and is engagable in the corresponding tangential channel 122 of the flange 89, 90. Each jaw 117 has a chamfered end 121 to assist the insertion into the channel 122 during the radial movement of the gripper element 53, 54 by means of the cylinder 68 (FIG. 1). Each axial channel 123 is engagable by a through-pin 124 which is forced into an adjacent hole in the end 121 of the corresponding jaw 117. Finally, each jaw 117 is provided with another end 126 provided with a pin 127. On the two pins 127 are pivoted, on one side, a pneumatic cylinder 128 and, on the other, a rod 129 for the associated piston.

In order to grip a punch 8 or a die 9, the gripper element 53, 54 is now brought into alignment with the seat 22, 29 of the turrets 6 and 7, and the seat 36 and 37 of the magazine 31, by means of the pneumatic cylinders 68. Then, by operating the cylinder 128 to separate the two pins 127, the two jaws 117 close, engaging in the tangential channels 122, while the two pins 124 engage the two axial channels 123, thus locking the flange 89, 90 in two orthogonal directions. The crosspiece 119 can now be raised along the axis of the punch 8 and the die 9 by means of the cylinder 69, 71 (see FIG. 1 also) in order to remove the punch 8 or the die 9 from the respective seat.

In order to insert the punch 8 or the die 9 into the respective seat, the reverse movements to those described above are effected. In particular, by operating the cylinder 128 so as to bring the two pins 124 together, the two jaws 117 and the associated pins 124 disengage from the channels 122 and 123, freeing the flange 89, 90.

Figure 7:
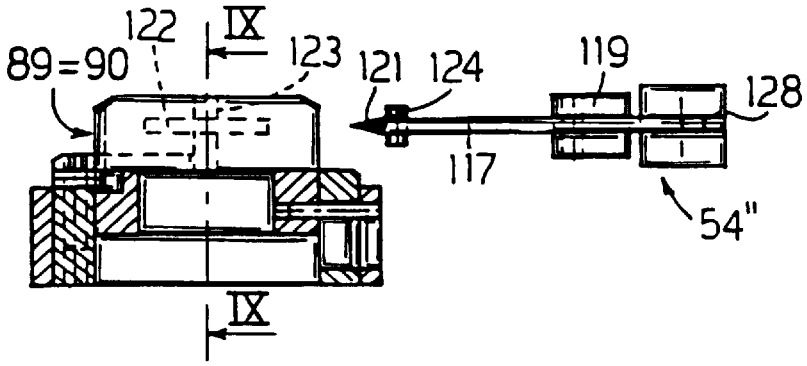
FIG. 7 is a side view in partial section of a gripper element according to another embodiment of the invention.
Figure 8:
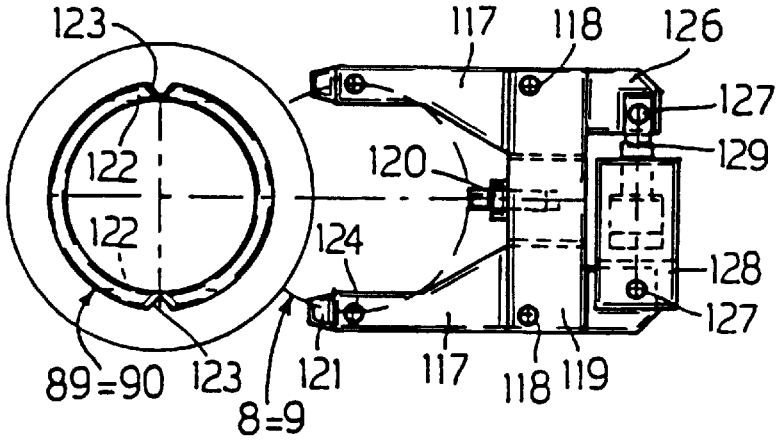
FIG. 8 is a view from above of the gripper element of FIG. 7.
Figure 9:
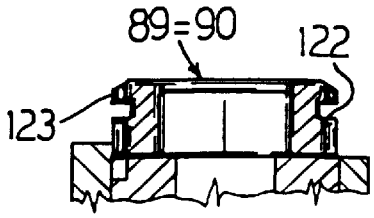
FIG. 9 is a section taken on the line IX—IX of FIG. 7.

The embodiment of FIGS. 7, 8 is particularly advantageous where the punching machine 1 has two turrets 6", 7" (FIG. 10) having the same diameter, so that they are coaxial. In this case, it is sufficient for the space 73 between the two turrets 6" and 7" to be at least equal to the height of the die 9, so that the insertion and removal from the seat 29 by means of the pneumatic cylinder 71 is possible. The operation of the cylinder 68 of the arm 49 can then be utilised in order radially to move the die 9 into the space 73.

From that seen above, the advantages of the gripper elements 53, 54 provided with horizontally moveable jaws, with respect to the known gripper elements, are clear. In particular, as for the jaws 131, the form of the jaws 117 with the pins 124 always ensures that the punch 8 and the die 9 are locked in two orthogonal directions, ensuring the relative horizontal and vertical alignment with the seats 22, 29; 33, 34. Furthermore, the jaws 117 enable the changeover of the punch-die pair 8, 9, even when the turrets 6", 7" have the same diameter and the axial space 73 between them is very limited.

It is clear that various modifications and improvements may be introduced into the gripper elements of FIGS. 2 to 9 without by this departing from the ambit of the associated claims. For example, the pin 124, 138 can have a wedge-shape section as well as circular section. In addition, the actuator 128, 129; 142, 143 can be of different type and transmit the movement to the jaws 117, 131 through different intermediate means.

What is claimed is:

1. A gripper element for a punch or a die of a punching machine provided with a changeover device (32) for a punch-die pair (8, 9) including at least a pair of jaws (117, 131) operable by a common actuator (127, 182, 142, 143):

wherein said jaws (117, 131) are moveable so as to engage in two corresponding pairs of channels (122, 123, 136, 137) of a flange (89, 90) of said punch (8) or said die (9);

wherein said two pairs of channels (122, 123; 136, 137) are diametrically opposed on each of said flanges (89, 90), said channels (122, 123; 136, 137) of each said pair being perpendicular to each other;

wherein a first of said channels (122, 136) of each said pair has a rectangular cross section, a second of said channels (123, 137) having a triangular cross section;

wherein said jaws (117, 131) have a rectangular cross section in order to engage with said first of said channels (122, 136);

wherein each of said jaws (117, 131) carries a pin (124, 138) projecting from said rectangular cross section of said jaws (117, 131) in opposite directions for engaging said second of said channels (123, 137;

wherein said pin (124, 138) is disposed adjacent an end (121) 135) of said jaws (117, 131), said end (121, 135) being chamfered; and wherein said laws (117, 131) are are pivoted on two parallel pins (118, 134) of a crosspiece (119, 133) for pivoting by an actuator (128, 129; 142, 143) disposed between two other pins (127, 141) of said jaws (117, 131).

2. A gripper element according to claim 1, characterised in that said parallel pins (134) are perpendicular to the axis of said punch (8) or said die (9), said jaws (131) being moveable on a plane parallel to said axis.

3. A gripper element according to claim 2, characterised in that said first channel (136) is parallel to the said axis, said other channel (137) being tangential to each of said flanges (89, 90).

4. A gripper element according to claim 3, characterised in that said jaws (131) are also controlled by an element (147) axially moveable with respect to the said first crosspiece (133) in order to open the said jaws positively.

5. A gripper element according to claim 4, characterised in that said element is formed from a second crosspiece (147) which cooperates with two cam edges (149), each provided on one of said jaws (131).

6. A gripper element according to claim 5, characterised in that another actuator (144, 146) is disposed between said crosspieces (133, 147) for controlling axial movement of said second crosspiece (147).

7. A gripper element according to claim 2, characterised in that the flange (89) of said punch (8) is carried by a punch tool (24) that is elastically moveable in a punch holder (23), said holder (23) being provided with a truncated cone-shape zone (25) to assist its insertion in seats (22, 36).

8. A gripper element according to claim 1, characterised in that said parallel pins (118) are also parallel to the axis of said punch (8) or said die (9), said jaws (117) being moveable on a plane perpendicular to said axis.

9. A gripper element according to claim 8, characterised in that said first channel (122) is tangential to said flange (89, 90), the said other channel (23) being parallel to said axis.

10. A gripper element according to claim 8, characterised in that said crosspiece (119) has a controllable radial stop element (120) for holding said flange (89, 90), separate actuation means (69, 71) being provided for removing said punch (8) or the said die (9) from a seat (22, 29, 36, 37), or for inserting them said seat (22, 29, 36, 37).

11. A gripper element according to claim 1, and further comprising said punching machine, wherein said punching machine is a turret punching machine in which said changeover device (32) comprises a pair of arms (48, 29), each provided with at least one said gripper element (53, 54), said pair of jaws (117, 131) being carried on a body (100, 105) releasably mounted on a corresponding arm (48, 49).

12. A gripper element according to claim 11, characterized in that said body (100, 105) is moveable on a prismatic guide (64) of said corresponding arm (48, 49), disposed parallel to an axis of said punch (8) or said die (9), an actuator (69, 71) being provided for moving said body along said prismatic guide (64).

13. A gripper element for a punch or a die of a punching machine provided with a changeover device (32) for a punch-die pair (8, 9) including at least a pair of jaws (117, 131) operable by a common actuator (127, 182, 142, 143):

wherein said jaws (117, 131) are moveable so as to engage in two corresponding pairs of channels (122, 123, 136, 137) of a flange (89, 90) of said punch (8) or said die (9);

wherein said two pairs of channels (122, 123; 136, 137) are diametrically opposed on each of said flanges (89, 90), said channels (122, 123; 136, 137) of each said pair being perpendicular to each other;

wherein a first of said channels (122, 136) of each said pair has a rectangular cross section, a second of said channels (123, 137) having a triangular cross section;

wherein said jaws (117, 131) have a rectangular cross section in order to engage with said first of said channels (122, 136);

wherein each of said jaws (117, 131) carries a pin (124, 138) projecting from said rectangular cross section of said jaws (117, 131) in opposite directions for engaging said second of said channels (123, 137);

wherein said pin (124, 138) is disposed adjacent an end (121) 135) of said jaws (117, 131), said end (121, 135) being chamfered; and wherein a sensor (S) in said first of said channels, (122, 136) releases said jaws (117, 131) to close completely.

14. A gripper element according to claim 4, characterised in that a sensor (S) in said first of said channels (122, 136) controls axial movement of said element (147) for releasing said jaws (117, 131) to close completely.

15. A gripper element according to claim 5, characterised in that a sensor (S) in said first of said channels (122, 136) controls axial movement of said element (147) for releasing said jaws (117, 131) to close completely.

16. A gripper element according to claim 6, characterised in that a sensor (S) in said first of said channels (122, 136) controls axial movement of said element (147) for releasing said jaws (117, 131) to close completely.

* * * * *